US006701755B1

(12) United States Patent
Irvin et al.

(10) Patent No.: US 6,701,755 B1
(45) Date of Patent: Mar. 9, 2004

(54) PANTY, PANTYHOSE OR SIMILAR ARTICLE

(75) Inventors: Bobby L. Irvin, High Point, NC (US); Leonard E. Russell, Snow Camp, NC (US); Stephen B. Collins, Seagrove, NC (US)

(73) Assignee: Henderson Machinery, Inc., Greensboro, NC (US)

( * ) Notice: Subject to any disclaimer, the term of this patent is extended or adjusted under 35 U.S.C. 154(b) by 0 days.

(21) Appl. No.: 10/314,909

(22) Filed: Dec. 9, 2002

Related U.S. Application Data

(63) Continuation-in-part of application No. 09/608,712, filed on Jun. 30, 2000, now Pat. No. 6,490,890.

(51) Int. Cl.[7] ..... A41B 9/00
(52) U.S. Cl. ..... 66/177; 66/8
(58) Field of Search ..... 66/171, 172 R, 66/178 R, 177, 180, 189, 8, 215

(56) References Cited

U.S. PATENT DOCUMENTS

| | | | | |
|---|---|---|---|---|
| 2,344,773 A | | 3/1944 | Herbert | 36/10 |
| 2,962,884 A | | 12/1960 | Garrou et al. | 66/177 |
| 3,109,300 A | | 11/1963 | Garrou et al. | 66/177 |
| 3,109,301 A | | 11/1963 | Garrou et al. | 66/177 |
| 3,143,870 A | | 8/1964 | Smith | 66/170 |
| 3,937,040 A | | 2/1976 | Negri | 66/177 |
| 3,946,579 A | | 3/1976 | Heinig | 66/177 |
| 3,956,909 A | | 5/1976 | Negri | 66/177 |
| 4,000,630 A | | 1/1977 | Imboden | 66/177 |
| 5,023,957 A | | 6/1991 | Harvey | 66/178 |
| 5,560,226 A | | 10/1996 | Throneburg | 66/185 |
| 6,490,890 B1 | * | 12/2002 | Irvin et al. | 66/177 |

FOREIGN PATENT DOCUMENTS

DE 28 18 506 11/1978

* cited by examiner

*Primary Examiner*—Danny Worrell
(74) *Attorney, Agent, or Firm*—MacCord Mason PLLC

(57) ABSTRACT

A knitted textile articles and a preform forming a panty, pantyhose or similar article. The preform includes a tubular knit body and a pair of opposed longitudinal segments extending the length of the tubular body. The longitudinal segments include both complete and partially omitted courses, which produces a unique shape suitable as a preform for subsequently forming other useful textile articles. In the preferred embodiment, the longitudinal segments further include elastic yarn, which aids in forming the shape of the preform. Also, in the preferred embodiment, elastic end bands are formed during knitting to each end of the knitted article. These end bands then become a part of the final textile article.

35 Claims, 10 Drawing Sheets

FIG. 8

PANTY, PANTYHOSE OR SIMILAR ARTICLE

CROSS-REFERENCE TO RELATED PATENTS

This application is a continuation-in-part of U.S. patent application Ser. No. 09/608,712, filed Jun. 30, 2000, now U.S. Pat. No. 6,490,890, issued Dec. 10, 2002, the entire disclosure of which is hereby incorporated by reference, and is referred to as herein as the "parent."

BACKGROUND OF THE INVENTION (1) Field of the Invention

The present invention relates generally to knitted textile articles and, more particularly, to a knitted preform for forming a panty, pantyhose or similar article.

(2) Description of the Prior Art

Typically, panty fabric is knit as a tube of fabric with an elastic band for the waist at one end. The end of the tube opposite of the waistband includes some lines formed by the machine during knitting to guide the cut out for the legs. This fabric is cut away and wasted. Then elastic is sewn to make the leg opening. The tube is then closed with a seam in the bottom. Likewise, a footie is knit as a tube, cut and then one end sewn to form the toe. However, reciprocation is normally needed.

Thus, there remains a need for a new and improved knitted preform for making a panty while, at the same time, having the elastic for the legs already in place.

SUMMARY OF THE INVENTION

The present invention is directed to knitted textile articles and a preform forming a panty, pantyhose or similar article. The preform includes a tubular knit body and a pair of opposed longitudinal segments extending the length of the tubular body. The longitudinal segments include complete and partially omitted courses, which produces a unique shape suitable as a preform for subsequently forming other useful textile articles. In the preferred embodiment, the longitudinal segments further include elastic yarn, which aids in forming the shape of the preform. Also, in the preferred embodiment, elastic end bands are formed during knitting to each end of the knitted article. These end bands then become a part of the final textile article.

In one embodiment, disclosed in the parent application, a substantially longitudinal cut is made through the tubular knit body opposite from the longitudinal segment, thereby forming a panty. A waistband may then be attached to the substantially longitudinal cut through the tubular knit body. Also, a pair of hose may be attached to the end bands, thereby forming a pair of pantyhose.

In another embodiment, disclosed in the parent application, a substantially longitudinal cut is made through the longitudinal segment opposite from the tubular knit body, thereby forming a footie. Stitching may then be added to connect the cut ends of the elastic end bands.

Accordingly, one aspect of the present invention is to provide a knitted article. The article includes a tubular knit body; and a pair of opposed longitudinal segments extending the entire length of the tubular body, the longitudinal segments including both complete and partially omitted courses.

Another aspect of the present invention is to provide a knitted article. The article includes a tubular knit body; and a pair of opposed longitudinal segments extending the entire length of the tubular body, the longitudinal segments including partially omitted courses, the longitudinal segments further including elastic yarn.

Still another aspect of the present invention is to provide a knitted article. The article includes: a tubular knit body; a pair of opposed longitudinal segments extending the entire length of the tubular body, the longitudinal segments including partially omitted courses, the longitudinal segments further including elastic yarn; and at least one end band attached to one end of the knitted article.

These and other aspects of the present invention will become apparent to those skilled in the art after a reading of the following description of the preferred embodiment when considered with the drawings.

BRIEF DESCRIPTION OF THE DRAWINGS

FIG. 8 is a schematic diagram of the courses used to knit the end bands of the apparel preform of the parent invention.

DESCRIPTION OF THE PREFERRED EMBODIMENTS

Figure 1:
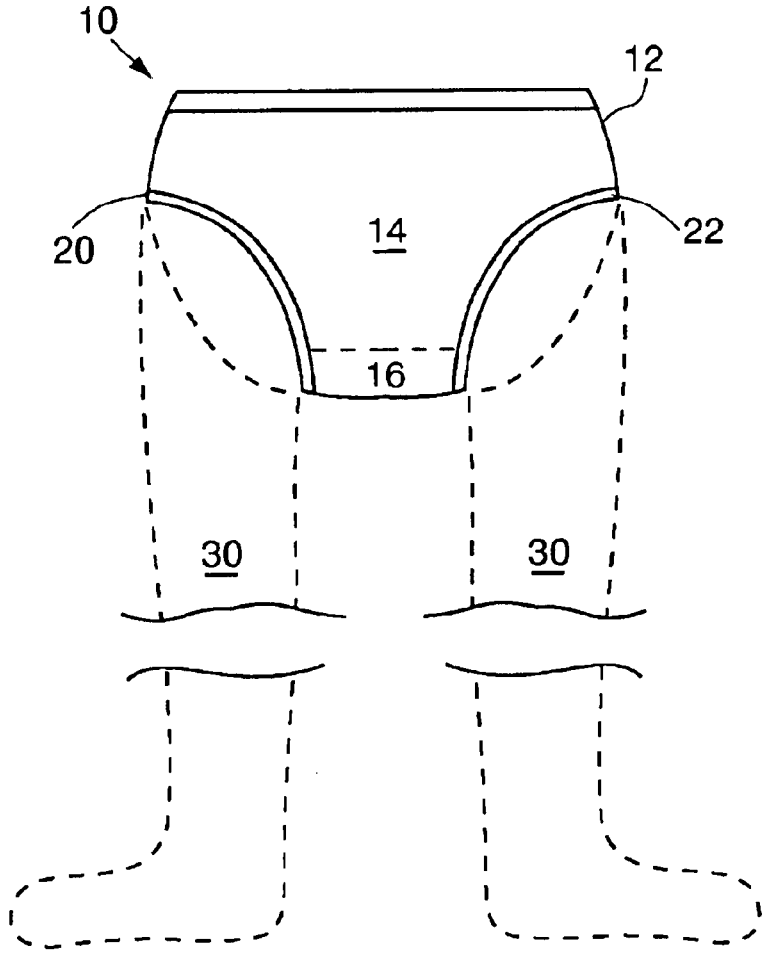
FIG. 1 is a perspective view of a pair of pantyhose made from the apparel preform constructed according to the parent invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a panty, pantyhose or similar article, generally designated 10, is shown constructed according to the parent invention. The textile article 10 includes a knitted preform 12 including a tubular knitted body 14 and a longitudinal segment having partially omitted courses 16. End bands 20, 22 form the leg openings and leggings 30 are attached to the leg openings.

Figure 2:
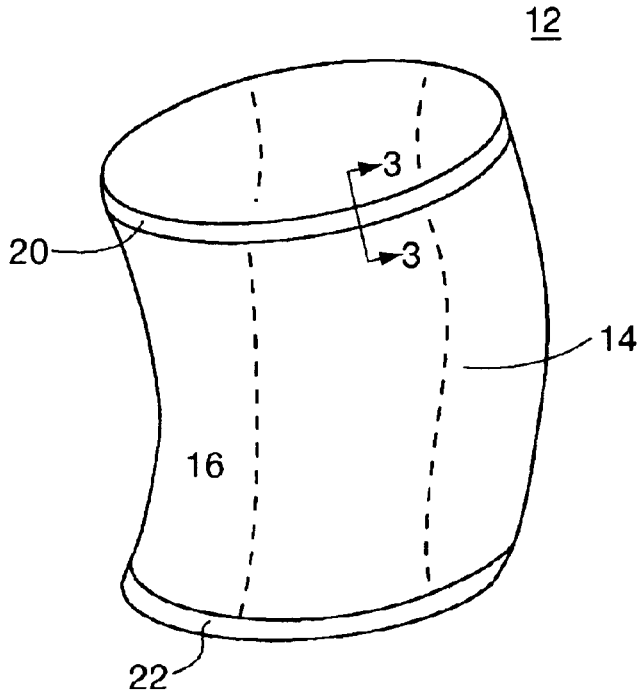
FIG. 2 is a side perspective view of an apparel preform of the parent invention.

The knitted preform 12 of the parent invention is best seen in FIG. 2. In the preferred embodiment, the knitted preform 12 is a jersey knit. The longitudinal section 16 is formed by partially omitting some of the yarn courses. The longitudinal section 16 thus contains less fabric than the remainder of the tubular knit body 14, thereby forming the asymmetric knitted preform 12. In the preferred embodiment, the longitudinal section 16 preferably comprises between about 25 and 33% of the tubular knit body 14. The actual amount depends on the panty or footie size being formed.

Figure 6:
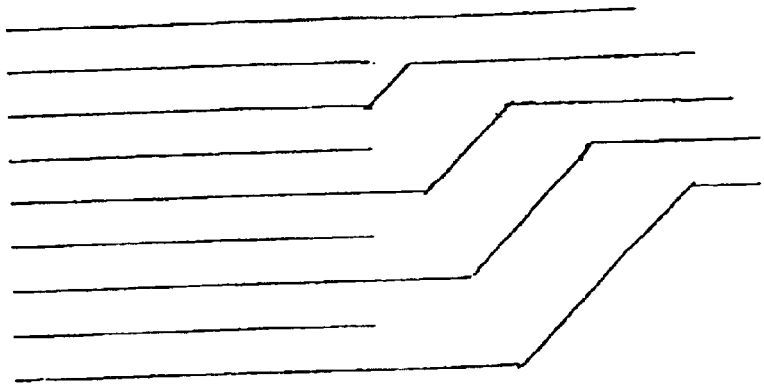
FIG. 6 is a schematic diagram showing how the longitudinal section of the tubular knit body is formed by omitting courses.
Figure 7:
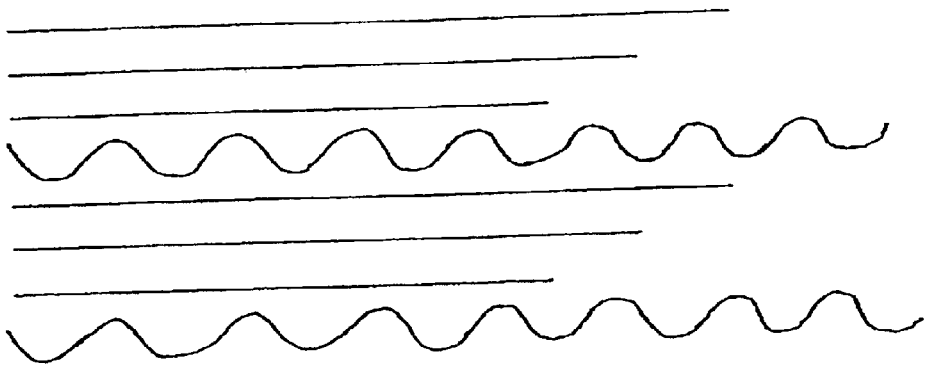
FIG. 7 is a schematic diagram of a contour knitting pattern.

A schematic of the successive dropping of courses that is used to form the longitudinal section(s) 16 in both the parent application and the present invention is shown in FIG. 6. In the preferred embodiment, the longitudinal section 16 is formed by successively stopping knitting on needles and knitting is performed only on every fourth course as shown in FIG. 7. In order to better accommodate the shape of the human body, the longitudinal 16 may be knit in a contoured pattern of staggered ends, such as that shown in FIG. 8. The contoured pattern is formed by stopping knitting on successive courses at different points. The pattern can be then be repeated or altered as desired to yield the proper garment contour or fit.

In the preferred embodiment in both the parent application and the present invention, the knitted preform 12 is knitted from nylon and an elastic yarn, such as Spandex or Dorlastan (manufactured by Bayer Corp., Bushy Park S.C.) and has a ratio of elastic to nylon ends of about 3:1. Referring back to FIG. 7, the elastic end is preferably knit on every fourth needle. Thus, three courses of nylon are knit, followed by a course of elastic yarn, which is knit while being kept under partial tension.

Figure 3:
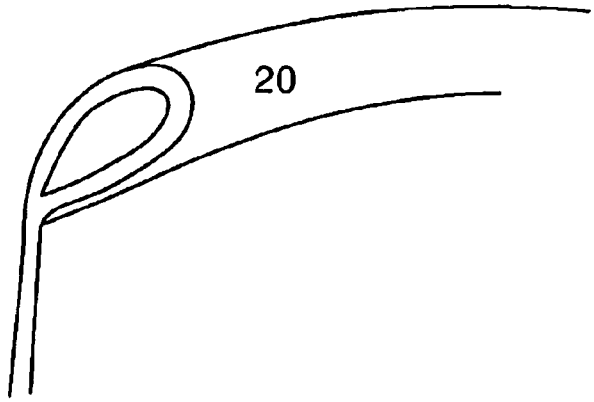
FIG. 3 is a partial perspective view of the parent invention, showing an end band that has been doubled back.

As best seen in FIG. 3 in both the parent application and the present invention, the fabric at each of the end bands 20, 22 is doubled back and knit into the tubular knit body 14, thereby forming an elastic leg or foot band. In the present invention, a single end band 20 may be used to form the elastic leg or foot band as will be described in more detail later. The width of the doubled back portion is between ⅛ and ½ inch and preferably about ¼ inch.

Figure 4:
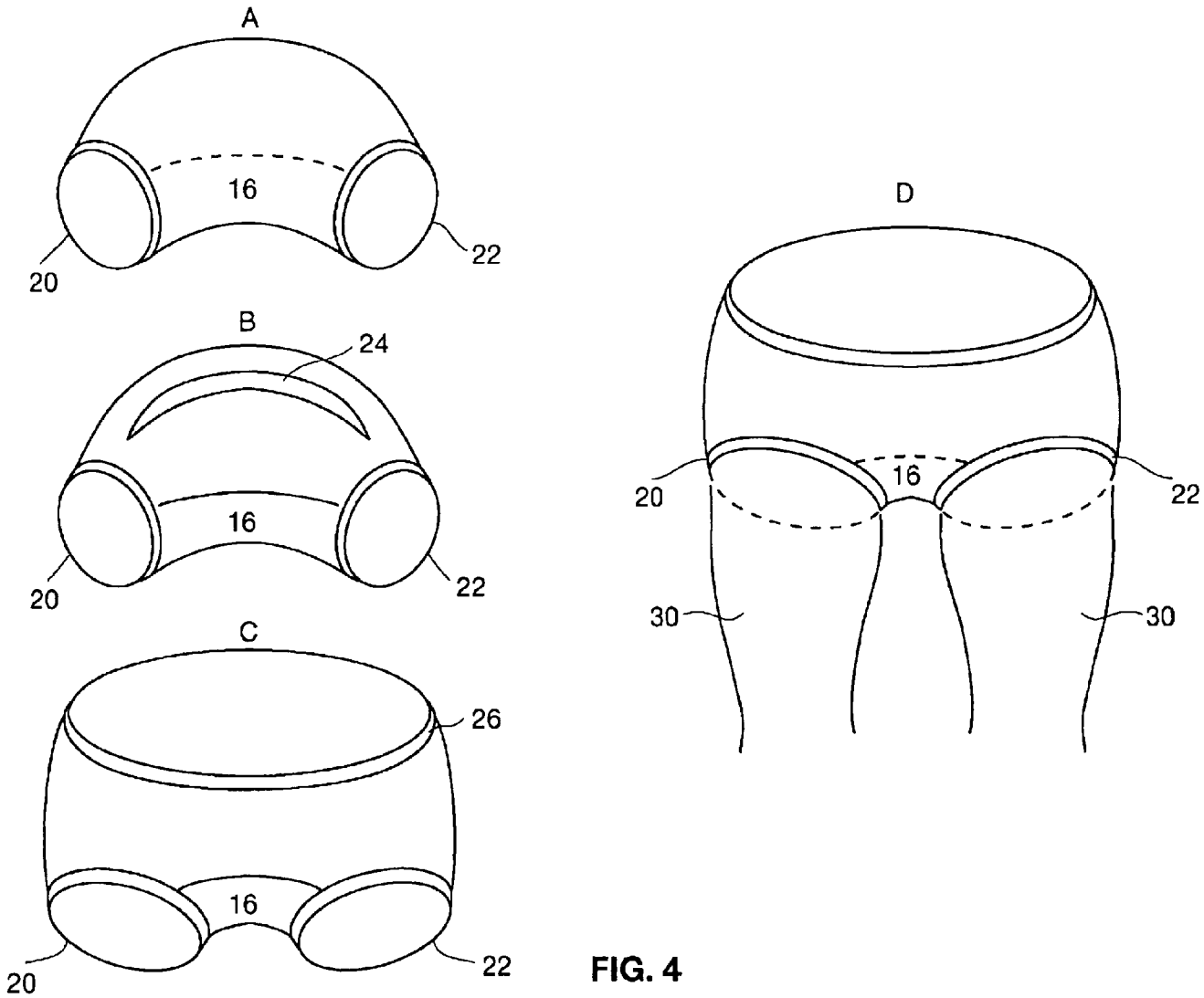
FIG. 4 is a series of perspective views showing how the apparel of the parent invention is used to produce a panty or a pair of pantyhose.

A garment, such as a panty or a pair of pantyhose 10 (such as shown in FIG. 1), may be made from the knitted preform 12 of the parent invention according to the sequence shown in FIG. 4 in the parent application. A finished knitted preform 12 of the preferred embodiment is shown in FIG. 4A. FIG. 4B shows a longitudinal cut 24 made in the tubular knit body 14. The hole created by the longitudinal cut 24 forms the waist of the garment. A waistband 26, shown in FIG. 4C, is sewn onto the edge formed by the longitudinal cut 24. As such, the longitudinal cut 24 does not extend the entire length of the tubular body 14 and is positioned to ensure a proper fit of the garment. The end bands 20, 22 form the leg holes for the garment and the longitudinal section 16 forms the crotch. As shown in FIG. 4D, pantyhose 10 are finished by attaching legs 30 to the knitted preform 12 at end bands 20, 22.

Figure 5:
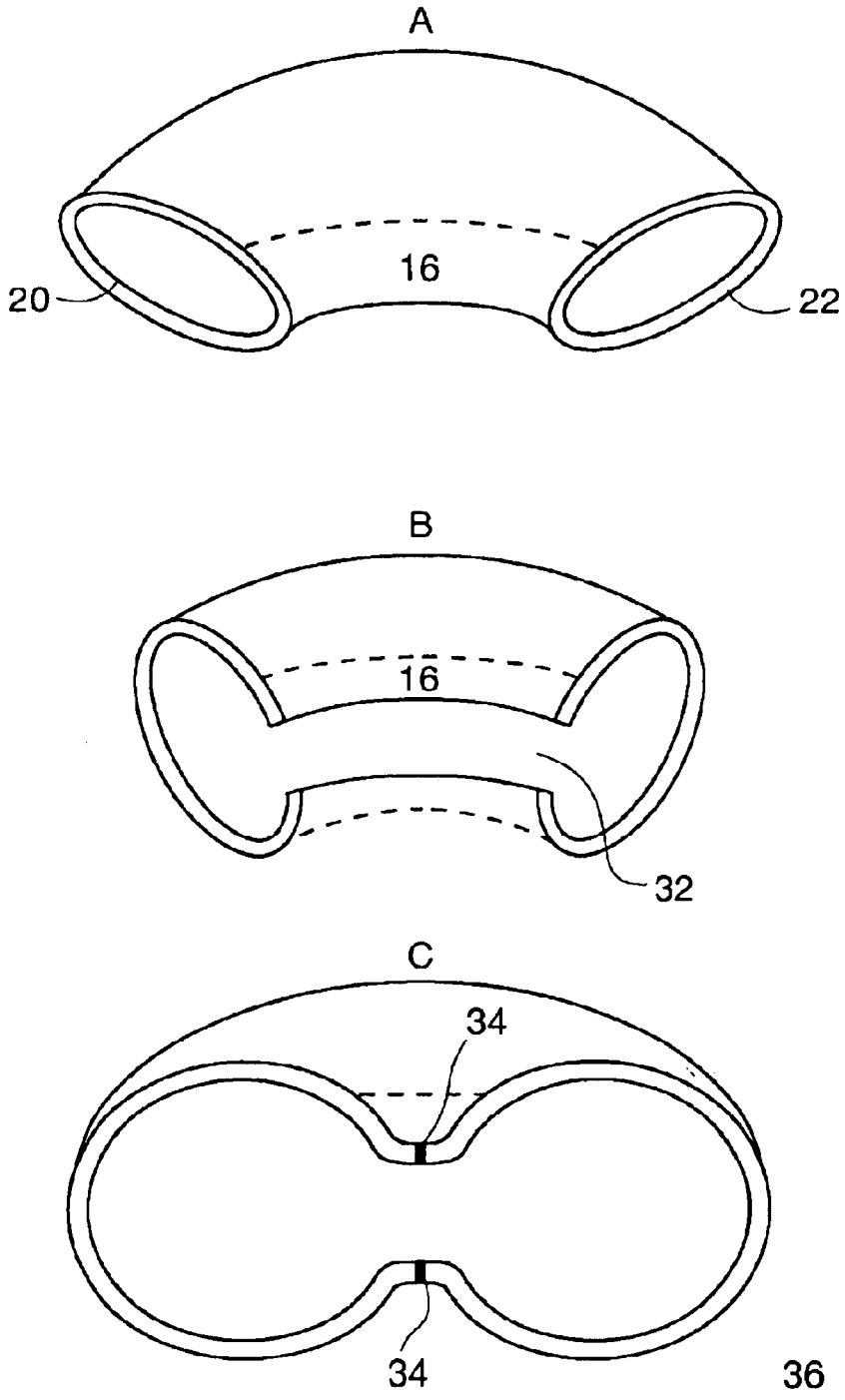
FIG. 5 is a series of perspective views showing how the apparel of the parent invention is used to produce a footie.

FIG. 5 illustrate how a footie is formed from the knitted preform 12 in the parent application. The knitted preform 12 for a footie, shown in FIG. 5A, may be much smaller than the preform for a panty shown in FIG. 4A. First, a longitudinal cut 32 is made through the longitudinal section 16 of the tubular knit body 14 as seen in FIG. 5B. The longitudinal cut 32 extends through end bands 20, 22, creating two ends on each end band. End bands 20 and 22 are joined at 34 to complete the footie 36 as shown in FIG. 5C.

In operation in both the parent application and the present invention, the preform for making a panty or a pair of pantyhose is made on a single cylinder fine gauge knitting machine. Starting at one end of the product the yarns start knitting on each of the feeds like a normal make up using the dial bitts and form a double elastic band or using the needles and make a double elastic band. After the band is complete, the feeds start knitting on only a portion of the needles and the yarn of each feed comes out and is trimmed. The amount of needles that knit is determined by the size of the panty and crotch area. This area may be changed during the knitting of the product to form a crotch that is wider in the back than front or any shape to fit the specific item being produced. It may vary to any amount of needles according to whatever amount of coverage you wish in the crotch.

The feeds that are knitting on only a portion of the needles may knit plain or pattern with textured nylon or any type of yarn. The feeds that are knitting on all the needles in the cylinder may have a covered spandex, cotton or any other type of yarn.

After knitting in the parent application, the garment is slit on a line that is created by the machine while the product is being knit. This slit line may be in the center of the area that forms the panty or it may be off center if more fabric is needed for the back or front. After slitting, elastic is sewn around the area to form the elastic for the waistband. This creates a panty without seams with the elastic for the legs already in place.

In operation in the parent application, the preform for making a footie is made on a single cylinder fine gauge knitting machine. Starting at one end of the product the yarns start knitting on each of the four feeds like a normal make-up and then every other needle stops knitting and stays at the low position to hold the yarn it picked up and not to pick up any more yarn. One feed includes covered spandex and the other feeds have textured nylon. In this way, the starting end of the fabric is held by the needles in the low position until the desired amount of fabric is knit. Then the needles that are in the low position start knitting normally for one revolution of the cylinder and this knits the starting end of the fabric back into the regular fabric and forms a double fabric to make an elastic band.

After the band is complete, three of the four feeds start knitting on only a portion of the needles and the yarn of each feed comes out and is trimmed. The amount of needles that knit is determined by the size of the footie that is being produced. It may vary from 300 to 350 or whatever amount of coverage you wish for the footie. The three feeds that knit are knitting only on the needles that are knitting plain knit with textured nylon yarn. The one feed that is knitting on all the needles in the cylinder includes a double covered spandex yarn and may knit a 1×1 tuck or in some styles may knit plain. If the feed that is knitting on all needles is making a 1×1 tuck then it may be using the 1×tuck only on the needles that are not knitting on the other three feeds. Knitting this way helps insure that the stitches will not run when the garment is slit.

After knitting in the parent application, the garment is slit on the center of the side that not much fabric is produced on. It is then seamed on a sewing machine at the ends of the double elastic bands. This forms a footie without a seam in the bottom and does not use a machine with reciprocation.

Figure 9:
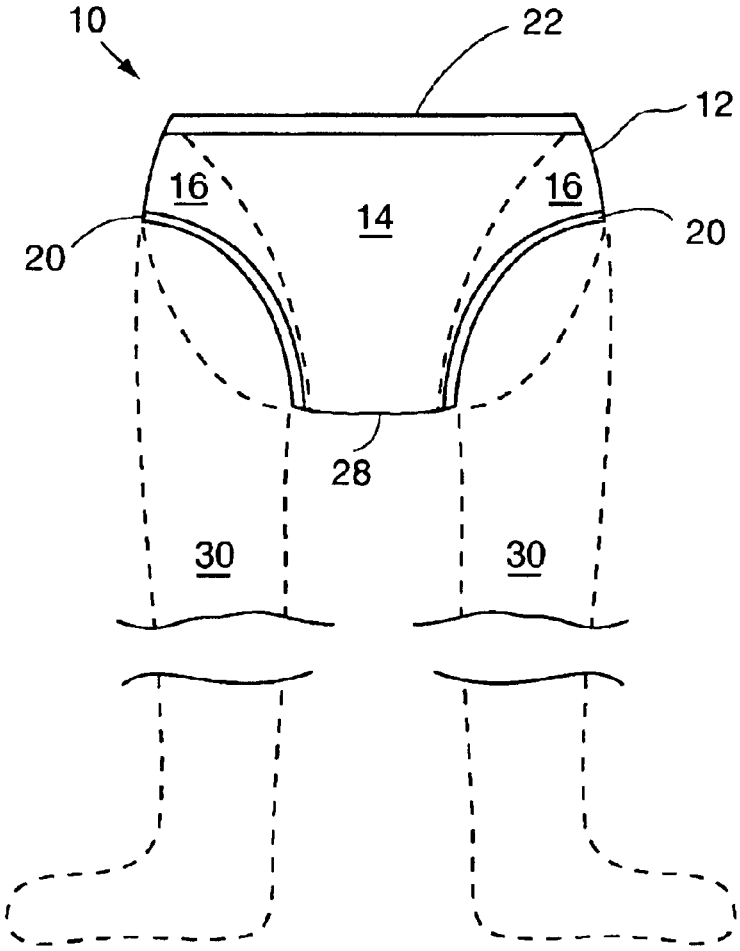
FIG. 9 is a perspective view of a pair of pantyhose made from the apparel preform constructed according to the present invention.

As best seen in FIG. 9, a panty, pantyhose or similar article, generally designated 10', is shown constructed according to the parent invention. The textile article 10' includes a knitted preform 12' including a tubular knitted body 14' and a pair of opposed longitudinal segments having both complete and partially omitted courses 16'. An end band 20' is cut and sewn by a seam 28 to form the leg openings and/or leggings 30 are attached to the leg openings. A second end band 22' may be used to form a waistband.

Figure 10:
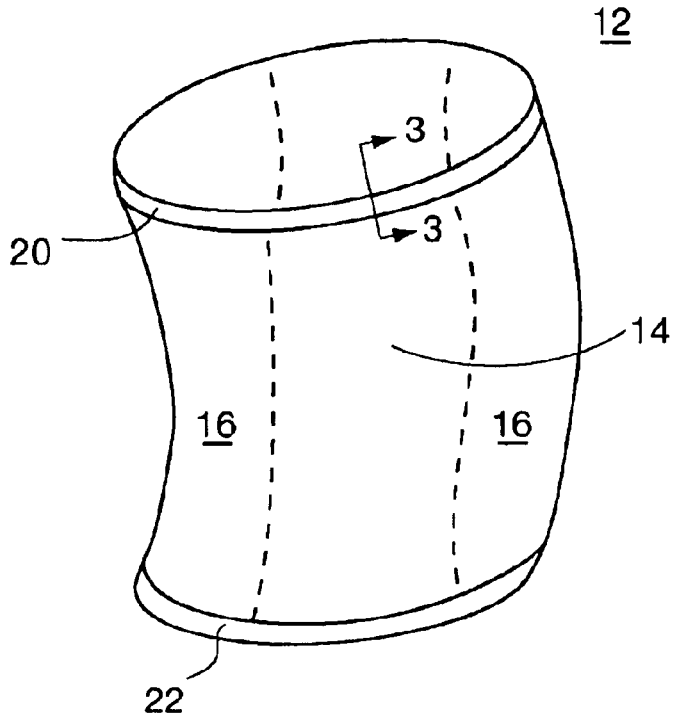
FIG. 10 is a side perspective view of an apparel preform of the present invention.

The knitted preform 12' of the present invention is best seen in FIG. 10. In the preferred embodiment, the knitted preform 12' may be a jersey knit. The longitudinal sections 16' are formed by partially omitted some of the yarn courses. The longitudinal sections 16' thus contain less fabric than the remainder of the tubular knit body 14', thereby forming the asymmetric knitted preform 12'. In the preferred embodiment, the longitudinal sections 16' preferably comprise between about 25 and 33% of the tubular knit body 14'. The actual amount depends on the panty size being formed.

A schematic of the successive dropping of courses that is used to form the longitudinal sections 16' was shown in FIG. 6 as described above.

Figure 11:
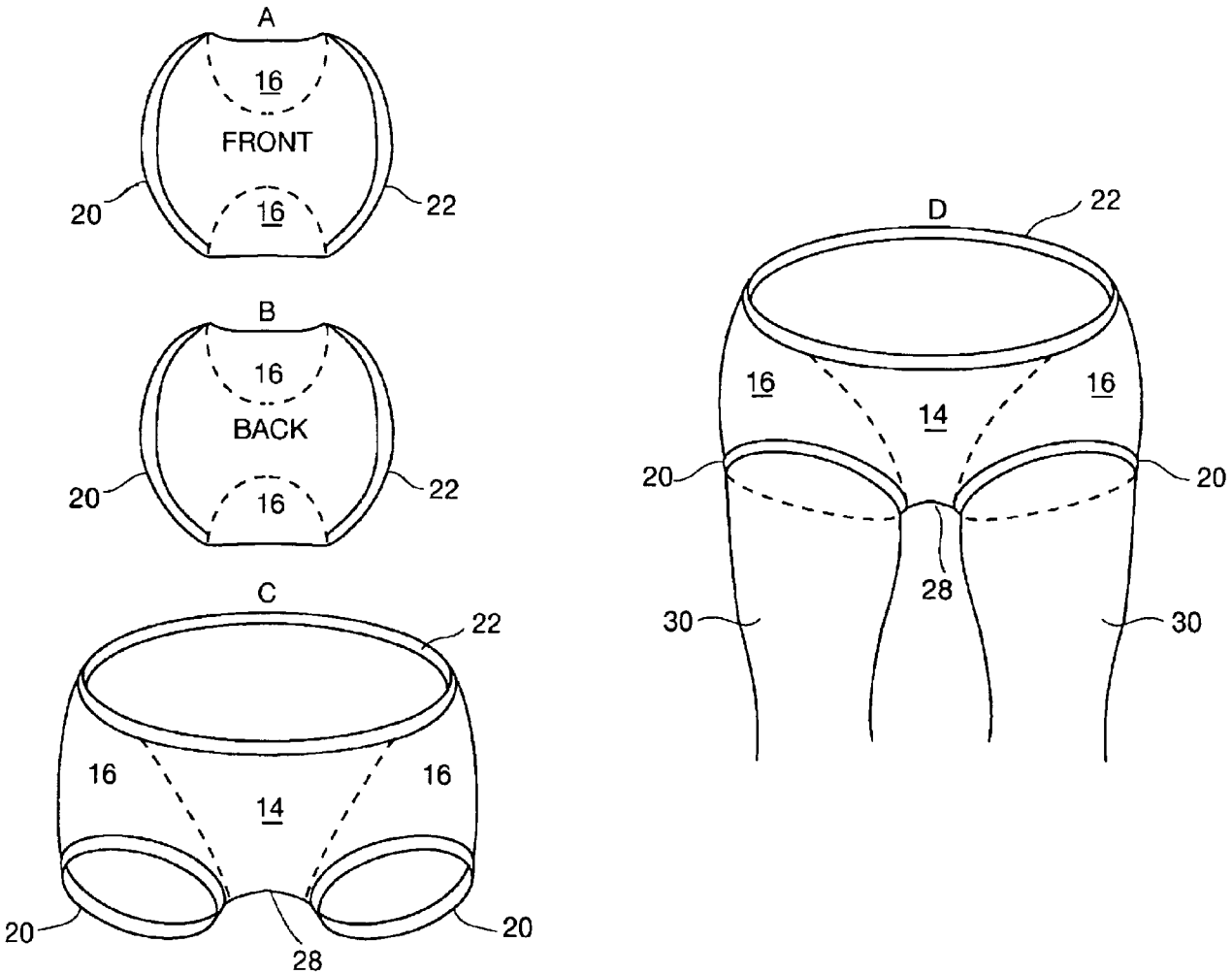
FIG. 11 is a series of perspective views showing how the apparel of the present invention is used to produce a panty or a pair of pantyhose.

A garment, such as a panty or a pair of pantyhose 10' (such as shown in FIG. 9), may be made from the knitted preform 12' of the present invention according to the sequence shown in FIG. 11. A front view of a finished knitted preform 12' of the preferred embodiment is shown in FIG. 11A. FIG. 11B shows a back view of a finished knitted preform 12'. As can be seen, the longitudinal sections 16' are preferably varied along the length of the knitted preform 12' for fit. As shown in FIG. 11C, end band 20' is cut and sewn along seam 28 to form the leg openings. A second end band 22' may be used to form a waist band. As shown in FIG. 11D, pantyhose 10' are finished by attaching legs 30 to the knitted preform 12' at cut and sewn end band 20'.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A knitted article, said article comprising:

(a) a tubular knit body; and (b) a pair of opposed longitudinal segments extending the entire length of said tubular body, said longitudinal segments including both complete and partially omitted courses.

2. The knitted article according to claim 1, further including at least one end band attached to one end of said knitted article.

3. The knitted article according to claim 2, wherein said first end band is an elastic band.

4. The knitted article according to claim 3, wherein said elastic end band is cut into two equal segments and sewn to form leg openings, thereby forming a panty.

5. The knitted article according to claim 4, further including a pair of hose attached to said end bands, thereby forming a pair of pantyhose.

6. The knitted article according to claim 3, wherein said elastic end band is a doubled fabric end band.

7. The knitted article according to claim 6, wherein said elastic doubled fabric end band is between about ⅛ and ½ inches wide.

8. The knitted article according to claim 7, wherein said elastic doubled fabric end band is about ¼ inches wide.

9. The knitted article according to claim 3, wherein said elastic end band is formed with an end to elastic end ratio of about 3.

10. The knitted article according to claim 9, wherein said elastic end is knit about every fourth needle.

11. The knitted article according to claim 3, further including a second elastic end band attached to the opposite end of said knitted article for forming a waist band.

12. A knitted article, said article comprising:

(a) a tubular knit body; and (b) a pair of opposed longitudinal segments extending the entire length of said tubular body, said longitudinal segments including both complete and partially omitted courses, said longitudinal segments further including elastic yarn.

13. The knitted article according to claim 12, wherein said longitudinal segments extend between about ¼ and ⅓ of the circumference of said tubular knit body.

14. The knitted article according to claim 12, wherein said longitudinal segments are formed with an end to elastic end ratio of about 3.

15. The knitted article according to claim 12, wherein said longitudinal segments are formed with a positive float stitch.

16. The knitted article according to claim 12, wherein said longitudinal segments are formed with staggered ends forming a V-contour pattern.

17. The knitted article according to claim 13, wherein said tubular knit body may be a jersey knit.

18. A knitted article, said article comprising:

(a) a tubular knit body;

(b) a pair of opposed longitudinal segments extending the entire length of said tubular body, said longitudinal segments including both complete and partially omitted courses, said longitudinal segments further including elastic yarn; and (c) at least one end band attached to one end of said knitted article.

19. The knitted article according to claim 18, wherein said first end band is an elastic band.

20. The knitted article according to claim 19, wherein said elastic end band is cut into two equal segments and sewn to form leg openings, thereby forming a panty.

21. The knitted article according to claim 20, further including a pair of hose attached to said end bands, thereby forming a pair of pantyhose.

22. The knitted article according to claim 19, wherein said elastic end band is a doubled fabric end band.

23. The knitted article according to claim 22, wherein said elastic doubled fabric end band is between about ⅛ and ½ inches wide.

24. The knitted article according to claim 23, wherein said elastic doubled fabric end band is about ¼ inches wide.

25. The knitted article according to claim 19, wherein said elastic end band is formed with an end to elastic end ratio of about 3.

26. The knitted article according to claim 25, wherein said elastic end is knit about every fourth needle.

27. The knitted article according to claim 19, further including a second elastic end band attached to the opposite end of said knitted article for forming a waist band.

28. The knitted article according to claim 18, wherein said longitudinal segments extend between about ¼ and ⅓ of the circumference of said tubular knit body.

29. The knitted article according to claim 18, wherein said longitudinal segments are formed with an end to elastic end ratio of about 3.

30. The knitted article according to claim 18, wherein said longitudinal segments are formed with a positive float stitch.

31. The knitted article according to claim 18, wherein said longitudinal segments are formed with staggered ends forming a V-contour pattern.

32. The knitted article according to claim 28, wherein said tubular knit body may be a jersey knit.

33. A method for forming a knitted article, said method comprising the steps of:

(a) knitting a tubular knit body; and (b) knitting a pair of opposed longitudinal segments extending the entire length of said tubular body, said longitudinal segments including both complete and partially omitted courses.

34. A method for forming a knitted article, said method comprising the steps of:

(a) knitting a tubular knit body; and (b) knitting a pair of opposed longitudinal segments extending the entire length of said tubular body, said longitudinal segments including both complete and partially omitted courses, said longitudinal segments further including elastic yarn.

35. A method for forming a knitted article, said method comprising the steps of:

(a) knitting a tubular knit body;

(b) knitting a pair of opposed longitudinal segments extending the entire length of said tubular body, said longitudinal segments including both complete and partially omitted courses, said longitudinal segments further including elastic yarn; and (c) attaching at least one end band to one end of said knitted article.

* * * * *